US009685113B2

(12) United States Patent
Chen et al.

(10) Patent No.: US 9,685,113 B2
(45) Date of Patent: Jun. 20, 2017

(54) ORGANIC LIGHT EMITTING DIODE PIXEL COMPENSATION CIRCUIT, AND DISPLAY PANEL AND DISPLAY DEVICE CONTAINING THE SAME

(71) Applicants: Shanghai Tianma AM-OLED Co., Ltd, Shanghai (CN); Tianma Micro-Electronics Co., Ltd., Shenzhen (CN)

(72) Inventors: Dan Chen, Shanghai (CN); Dong Qian, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 305 days.

(21) Appl. No.: 14/536,546

(22) Filed: Nov. 7, 2014

(65) Prior Publication Data

US 2015/0371587 A1 Dec. 24, 2015

(30) Foreign Application Priority Data

Jun. 23, 2014 (CN) ..... 2014 1 0283835

(51) Int. Cl.
*G09G 3/30* (2006.01)
*G09G 3/3233* (2016.01)

(52) U.S. Cl.
CPC ... *G09G 3/3233* (2013.01); *G09G 2300/0842* (2013.01); *G09G 2300/0861* (2013.01); *G09G 2320/045* (2013.01)

(58) Field of Classification Search
CPC ..... G09G 2300/0819; G09G 2320/045; G09G 2310/0251
See application file for complete search history.

(56) References Cited

U.S. PATENT DOCUMENTS

2007/0063932 A1* 3/2007 Nathan ..... G09G 3/3233 345/76
2008/0150846 A1* 6/2008 Chung ..... G09G 3/3233 345/80
2013/0127924 A1* 5/2013 Lee ..... G09G 3/32 345/690

FOREIGN PATENT DOCUMENTS

CN 101231821 A 7/2008

* cited by examiner

*Primary Examiner* — William Boddie
*Assistant Examiner* — Leonid Shapiro
(74) *Attorney, Agent, or Firm* — Anova Law Group, PLLC

(57) ABSTRACT

An OLED pixel compensation circuit includes first, second, third, fourth, fifth, sixth and seventh transistors and a storage capacitor. The first transistor has a gate electrode coupled to a scan signal, a first electrode coupled to a data signal, and a second electrode coupled to a gate electrode of the fifth transistor. The second transistor has a gate electrode coupled to the scan signal, a first electrode coupled to a power supply voltage, and a second electrode coupled to a second electrode of the storage capacitor. The third transistor has a gate electrode coupled to a first light emitting signal, a first electrode coupled to the power supply voltage. The transistors and the storage capacitor are configured to compensate the threshold voltage drift of the fifth transistor, which is the driving transistor for the OLED.

20 Claims, 5 Drawing Sheets

ORGANIC LIGHT EMITTING DIODE PIXEL COMPENSATION CIRCUIT, AND DISPLAY PANEL AND DISPLAY DEVICE CONTAINING THE SAME

CROSS REFERENCE TO RELATED APPLICATIONS

This application claims the benefit of priority to Chinese Patent Application No. 201410283835.2, filed with the Chinese Patent Office on Jun. 23, 2014 and entitled "ORGANIC LIGHT EMITTING DIODE PIXEL COMPENSATION CIRCUIT, AND DISPLAY PANEL DEVICE CONTAINING THE SAME", the content of which is incorporated herein by reference in its entirety.

BACKGROUND OF THE INVENTION

At present, as shown in FIG. 1, an organic light emitting diode (OLED) pixel driving circuit generally contains a transistor T11, a transistor T12, a storage capacitor C11 and various drive signals for driving the OLED. A specific circuit connection is shown in FIG. 1. A working process of the pixel driving circuit comprises stages as follows.

In the signal write-in stage, in the case that a scan signal Scan is at high-level, the transistor T12 is switched on, a data signal Data is input to a gate electrode of the transistor T11 through the transistor T12, hence the transistor T11 is switched on and a capacitor C11 is charged.

In the light emitting stage, the scan signal Scan is made to be at low-level, the transistor T12 is switched off, the capacitor C11 is discharged to enable the transistor T11 to be still on. A power supply voltage PVDD keep providing the OLED with a voltage until a next stage arrives. The above cycle is then repeated.

However, due to a limitation of a process level, during a process of manufacturing a transistor circuit of an OLED display, a drive current of the OLED display often deviates and a panel often displays abnormally due to a threshold voltage existed in a driving transistor.

BRIEF SUMMARY OF THE INVENTION

In view of the above, the present disclosure provides an organic light emitting diode (OLED) pixel compensation circuit, and a display panel and a display device which contain the circuit.

An OLED pixel compensation circuit according to an embodiment of the present disclosure is for driving the OLED to emit light. The OLED pixel compensation circuit comprises a first transistor, a second transistor, a third transistor, a fourth transistor, a fifth transistor, a sixth transistor, a seventh transistor and a storage capacitor. Specifically, a gate electrode of the first transistor is coupled to a scan signal, a first electrode of the first transistor is coupled to a data signal, and a second electrode of the first transistor is coupled to a gate electrode of the fifth transistor. A gate electrode of the second transistor is coupled to the scan signal, a first electrode of the second transistor is coupled to a power supply voltage, and a second electrode of the second transistor is coupled to a second electrode of the storage capacitor. A gate electrode of the third transistor is coupled to a first light emitting signal, a first electrode of the third transistor is coupled to the power supply voltage, and a second electrode of the third transistor is coupled to a first electrode of the fifth transistor. A gate electrode of the fourth transistor is coupled to the scan signal, a first electrode of the fourth transistor is coupled to the gate electrode of the fifth transistor, and a second electrode of the fourth transistor is coupled to the first electrode of the fifth transistor. A second electrode of the fifth transistor is coupled to a first electrode of the seventh transistor. A gate electrode of the sixth transistor is coupled to the first light emitting signal, a first electrode of the sixth transistor is coupled to the gate electrode of the fifth transistor, and a second electrode of the sixth transistor is coupled to the second electrode of the storage capacitor. A gate electrode of the seventh transistor is coupled to a second light emitting signal, and a second electrode of the seventh transistor is coupled to a first electrode of the OLED. A first electrode of the storage capacitor is coupled to the first electrode of the seventh transistor. And a second electrode of the OLED is coupled to a low-level signal, and the OLED emits light in response to a drive current generated by the fifth transistor.

A display panel according to an embodiment of the present disclosure contains the above OLED pixel compensation circuit.

A display device according to an embodiment of the present disclosure contains the above OLED pixel compensation circuit or the above display panel.

DETAILED DESCRIPTION OF THE PREFERRED EMBODIMENTS

To make the above object, features and advantages of the present disclosure more obvious and easy to be understood, in the following, particular embodiments of the present disclosure will be illustrated in detail in conjunction with the drawings.

More specific details will be set forth in the following descriptions for sufficient understanding of the disclosure, however the disclosure can also be implemented by other ways different from the way described herein, and therefore the disclosure is not limited to particular embodiments disclosed hereinafter.

Figure 1:
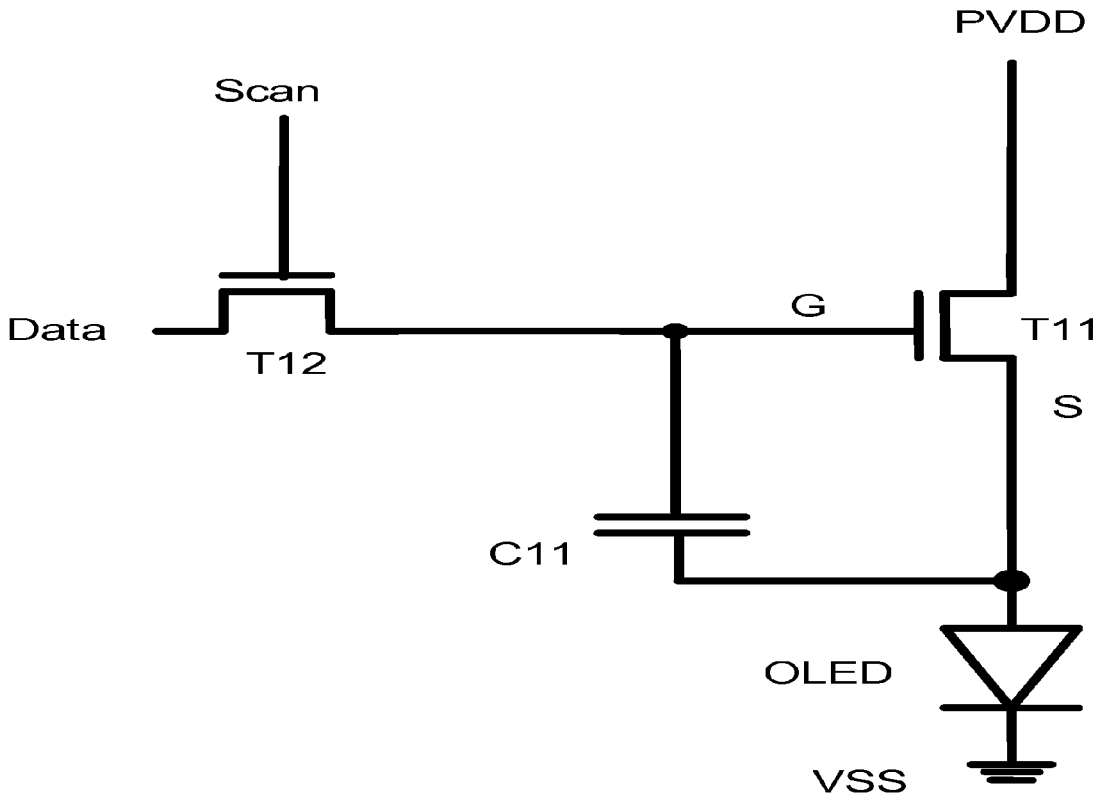
FIG. 1 (Prior Art)
FIG. 1 is an OLED pixel driving circuit in the prior art.
Figure 2A:
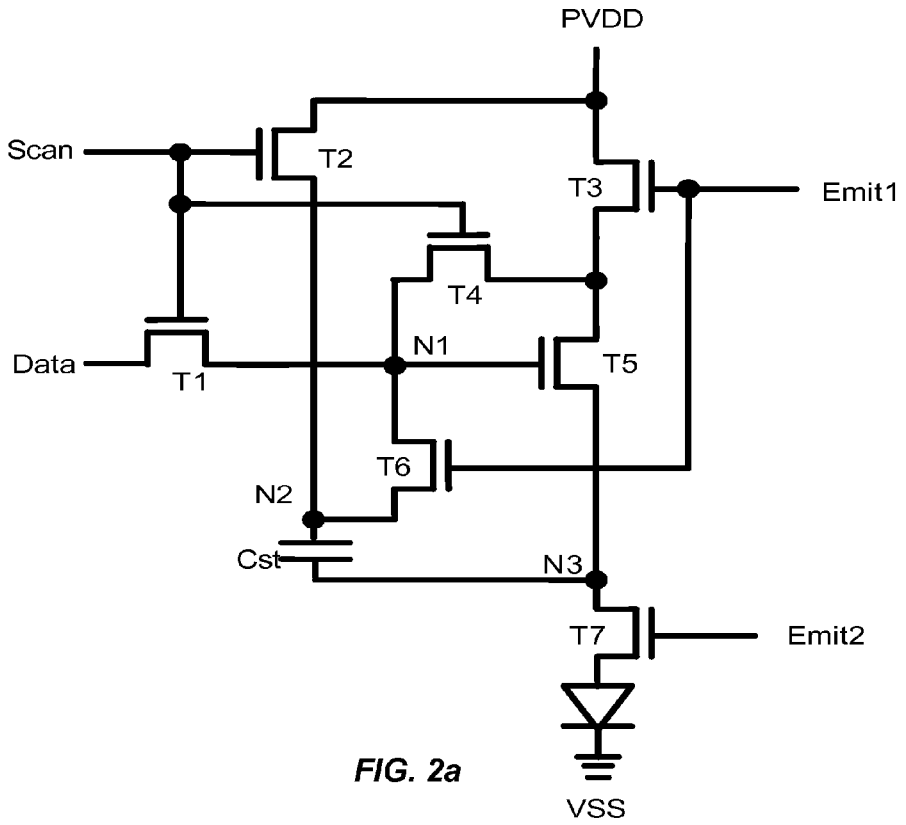
FIG. 2*a* is an OLED pixel compensation circuit according to an embodiment of the present disclosure.
Figure 2B:
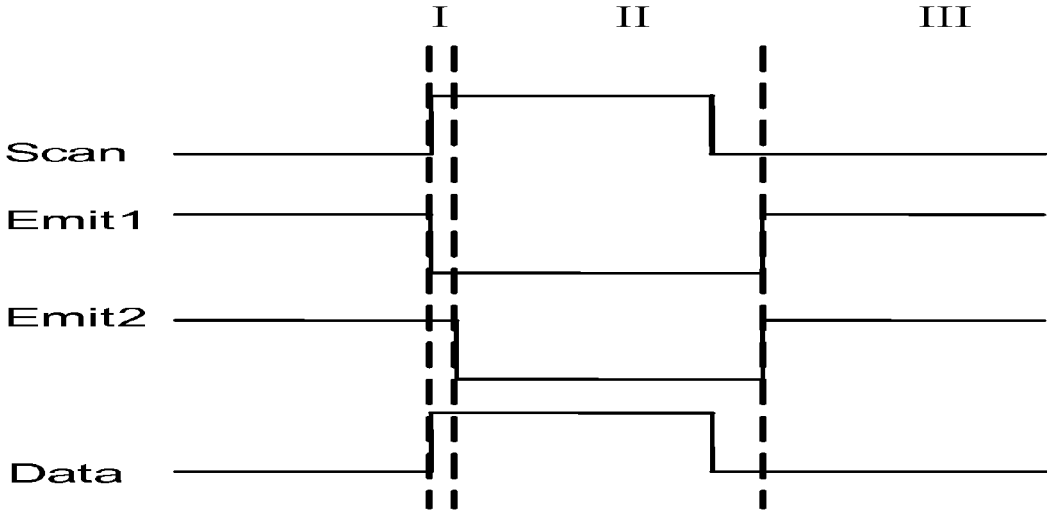
FIG. 2*b* is a timing diagram of an operation of the circuit shown in FIG. 2*a;*

Reference is made to FIGS. 2*a* and 2*b*. FIG. 2*a* is an OLED pixel compensation circuit according to an embodiment of the present disclosure, which is for driving the OLED to emit light. The OLED pixel compensation circuit comprises a first transistor T1, a second transistor T2, a third transistor T3, a fourth transistor T4, a fifth transistor T5, a sixth transistor T6, a seventh transistor T7 and a storage capacitor Cst. A gate electrode of the first transistor T1 is coupled to a scan signal Scan, a first electrode of the first transistor T1 is coupled to a data signal Data, and a second electrode of the first transistor T1 is coupled to a gate electrode of the fifth transistor T5 at a node N1. A gate electrode of the second transistor T2 is coupled to the scan signal Scan, a first electrode of the second transistor T2 is coupled to a power supply voltage PVDD, and a second electrode of the second transistor T2 is coupled to a second electrode of the storage capacitor Cst at a node N2. A gate electrode of the third transistor T3 is coupled to a first light emitting signal Emit1, a first electrode of the third transistor T3 is coupled to the power supply voltage PVDD and a second electrode of the third transistor T3 is coupled to a first electrode of the fifth transistor T5. A gate electrode of the fourth transistor T4 is coupled to the scan signal Scan, a first electrode of the fourth transistor T4 is coupled to the gate electrode of the fifth transistor T5 at node N1, and a second electrode of the fourth transistor T4 is coupled to the first electrode of the fifth transistor T5. A second electrode of the fifth transistor T5 is coupled to a first electrode of the seventh transistor T7. A gate electrode of the sixth transistor T6 is coupled to the first light emitting signal Emit1, a first electrode of the sixth transistor T6 is coupled to the gate electrode of the fifth transistor T5 and a second electrode of the sixth transistor T6 is coupled to the second electrode of the storage capacitor Cst at node N2. A gate electrode of the seventh transistor T7 is coupled to a second light emitting signal Emit2 and a second electrode of the seventh transistor T7 is coupled to a first electrode of the OLED. A first electrode of the storage capacitor Cst is coupled to the first electrode of the seventh electrode T7 at a node N3. And a second electrode of the OLED is coupled to a low-level signal VSS and the OLED emits light in response to a drive current generated by the fifth transistor T5.

Optionally, the first electrode of the OLED may be an anode of the OLED. The second electrode of the OLED may be a cathode of the OLED. And the "coupling" herein may be a direct connection or an indirect connection.

Specifically, the first transistor T1 is for transferring the data signal Data to the gate electrode of the fifth transistor T5 under the control of the scan signal Scan. The second transistor T2 is for transferring the power supply voltage PVDD to the second electrode of the storage capacitor Cst under the control of the scan signal Scan. The third transistor T3 is for transferring the power supply voltage PVDD received by the first electrode of the third transistor T3 to the second electrode of the third transistor T3, under the control of the first light emitting signal Emit1. The fourth transistor T4 is for transferring the data signal Data received by the first electrode of the fourth transistor T4 to the first electrode of the fifth transistor T5, under the control of the scan signal Scan. The fifth transistor T5 is for generating the drive current for driving the OLED to emit light. The sixth transistor T6 is for switching on the first and second electrodes of the sixth transistor T6 under the control of the first light emitting signal Emit1. The seventh transistor T7 is for making the drive current generated by the fifth transistor T5 drive the OLED to emit light. And the storage capacitor Cst is for storing a received voltage (a voltage received by the first electrode of the storage capacitor or a voltage received by the second electrode of the storage capacitor), and couple a change value of voltage on the second electrode of the storage capacitor to the first electrode of the storage capacitor or couple a change value of voltage on the first electrode of the storage capacitor to the second electrode of the storage capacitor.

In the following, a specific working process and a working principle are described. Referring to FIGS. 2*a* and 2*b*, all transistors in the OLED pixel compensation circuit are N-type Metal Oxide Semiconductor (NMOS) transistors. Therefore, the first electrode of the transistors may be a drain electrode and the second electrode of the transistors may be a source electrode. Driving the OLED pixel compensation circuit may comprise a first stage, a second stage and a third stage. And the first stage is a reset stage of the circuit, for initializing the circuit.

Specifically, in the first stage (denoted "I" in FIG. 2*b*), since Emit1 is output (also referred to as "supplied" or "provided") as a low-level signal, the third transistor T3 and sixth transistor T6 are switched off. Since the scan signal Scan is output as a high-level signal, the first transistor T1, the second transistor T2 and the fourth transistor T4 are switched on, and the data signal Data may be written into node N1 (the node N1 is an intersection node of the second electrode of the first transistor T1, the first electrode of the fourth transistor T4, the gate electrode of the fifth transistor T5 and the first electrode of the sixth transistor T6), that is, VN1=Vdata (a voltage of the data signal Data). In this case, since the data signal Data is a high-level signal, the fifth transistor T5 is switched on under the control of a high-potential (high-level) Vdata. Additionally, since the second light emitting signal Emit2 is also output as a high-level signal, the seventh transistor T7 is switched on, the OLED is lighted for a while and a potential of node N3 is VSS+Vo, with Vo being a voltage drop across the OLED.

The second stage (denoted "II" in FIG. 2*b*) is a threshold compensation stage of a driving transistor (the fifth transistor T5 in the present embodiment) in the circuit, for capturing a threshold voltage Vth of the fifth transistor. Specifically, in the second stage, the first light emitting signal Emit1 and the second light emitting signal Emit2 are output as low-level signals, therefore, the third transistor T3, the sixth transistor T6 and the seventh transistor T7 are switched off. Since the scan signal Scan is output as a high-level signal, the first transistor T1, the second transistor T2, the fourth transistor T4 are switched on, the data signal is written into the node N1, that is, VN1=Vdata, and a voltage of node N2 (the node N2 is an intersection node of the second electrode of the second transistor T2, the second electrode of the sixth electrode T6 and the second electrode of the storage capacitor Cst) is the power supply voltage PVDD. In the second stage, the data signal Data is a high-level signal, thus the fifth transistor T5 is switched on under the control of the high-potential (high-level) Vdata, and the data signal Data charges the storage capacitor Cst through the first electrode of the storage capacitor Cst. The charging process continues until a potential of node N3 (the node N3 is an intersection node of the second electrode of the fifth transistor T5, the first electrode of the seventh transistor T7 and the first electrode of the storage capacitor Cst) is Vdata−Vth and thus a condition for switching on the fifth transistor T5 (Vg−Vs is larger than Vth, with Vg being a gate voltage of the fifth transistor T5, Vs being a voltage of the second electrode of the fifth transistor T5, and Vth being a threshold voltage of the fifth transistor T5) is no longer met, hence the fifth transistor T5 is switched off, and the stage II is ended. In this case, a difference between voltages on two ends of the storage capacitor Cst is PVDD−Vdata+Vth.

The third stage (denoted "III" in FIG. 2*b*) is a light emitting stage of the circuit, for driving the OLED to emit light. Specifically, in the third stage, the scan signal Scan is output as a low-level signal, hence the first transistor T1, the second transistor T2 and the fourth transistor T4 are switched off. Since the first light emitting signal Emit1 and the second light emitting signal Emit2 are output as high-level signals, the third transistor T3, the sixth transistor T6 and the seventh transistor T7 are switched on, the two ends of the storage capacitor Cst are connected between the gate electrode and the second electrode of the fifth transistor T5 to maintain a sufficient voltage difference for a gate-source voltage Vgs (i.e. a voltage across the gate electrode of the fifth transistor T5 and the second electrode of the fifth transistor T5) of the fifth transistor T5 (as a driving transistor), to enable the fifth transistor T5 to be in a switched-on state. In this case, the fifth transistor T5 is switched on since charges stored in the storage capacitor Cst are constant due to charge conservation. With the drive current of the OLED becoming stable, a voltage of the node N3 will become Voled (Voled is a voltage drop across the OLED and here it is assumed that the low-level signal VSS is 0). In this case, since a bootstrap function of the storage capacitor Cst, i.e. there is a constant voltage difference between the two ends of the storage capacitor Cst, the voltages of the node N1 and N2 on the other end of the storage capacitor Cst may be changed to PVDD−Vdata+Vth+Voled. Thus, based on a formula for the drive current generated by the OLED, the drive current Ioled, which passes through the fifth transistor T5 and is for driving the OLEd to emit light, is directly proportional to a square of a difference value between the gate-source voltage (a voltage across the gate electrode and the second electrode) of the fifth transistor T5 and the threshold voltage of the fifth transistor T5, that is, $Ioled \propto (Vgs-Vth)^2=(Vg-Vs-Vth)^2=((PVDD-Vdata+Vth+Voled)-Voled-Vth)^2=(PVDD-Vdata)^2$. Therefore, the drive current of the OLED, Ioled, is independent of the threshold voltage Vth of the driving transistor T5, hence the threshold voltage of the driving transistor (the fifth transistor T5 herein) is compensated.

It can be seen that, with the OLED pixel compensation circuit according to the present embodiment, an influence of the threshold voltage of the driving transistor (the fifth transistor T5) on the generated driving current may be counteracted and the threshold voltage of the driving transistor is compensated. Thereby the driving current generated by the driving transistor does not deviate, and an OLED panel tends to display normally.

Figure 3A:
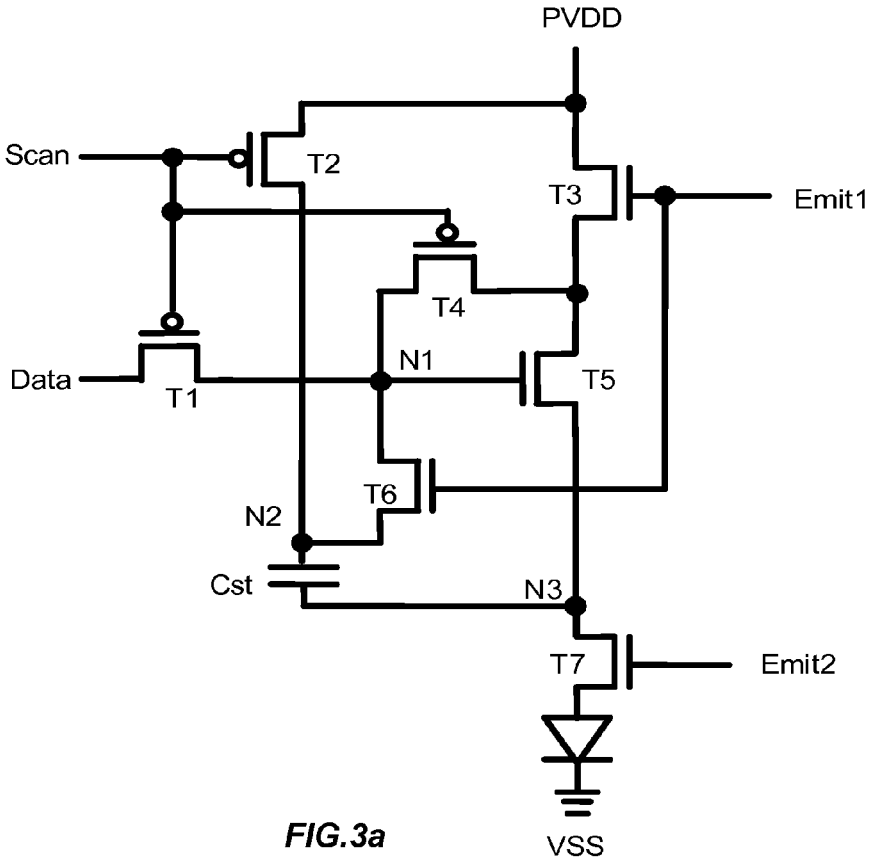
FIG. 3*a* is an OLED pixel compensation circuit according to an embodiment of the present disclosure.
Figure 3B:
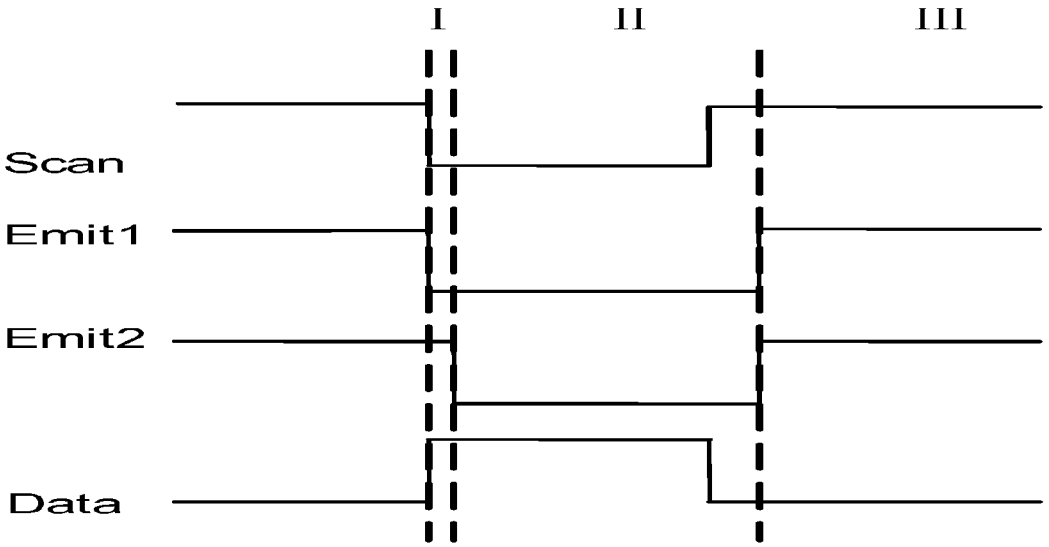
FIG. 3*b* is a timing diagram of an operation of the circuit shown in FIG. 3*a;*

Referring to FIGS. 3*a* and 3*b*, an embodiment is obtained based on the embodiment described above, as shown in FIG. 2*a* and FIG. 2*b*. A difference between the present embodiment and the above-described embodiment is that: in the present embodiment, a first transistor T1, a second transistor T2 and a fourth transistor T4 are P-type Metal Oxide Semiconductor (PMOS) transistors, and first electrodes of the PMOS transistors are source electrodes and second electrodes of the PMOS transistors are drain electrodes. Correspondingly, levels in the three stages in driving the OLED pixel, accordingly to vary as follows.

In the first stage I (reset stage), the scan signal Scan is a low-level signal, the first light emitting signal Emit1 is a low-level signal, a second light emitting signal Emit2 is a high-level signal and the data signal Data is a high-level signal.

In the second stage II (threshold compensation stage), the scan signal Scan is a low-level signal, the first light emitting signal Emit1 is a low-level signal, the second light emitting signal Emit2 is a low-level signal and the data signal Data is a high-level signal.

In the third stage III (light emitting stage), the scan signal Scan is a high-level signal, the first light emitting signal Emit1 is a high-level signal, the second light emitting signal Emit2 is a high-level signal. It should be noted that the data signal Data in this stage may be a high-level signal or a low-level signal.

A specific implementation process and a working principle in the present embodiment are similar to that in the embodiment as shown in FIGS. 2*a* and 2*b*, only because transistor types of the first transistor T1, the second transistor T2 and the fourth transistor T4 are changed from NMOS transistors into PMOS transistors, hence a level of a corresponding drive signal (the scan signal Scan) is also reversed. Since changes or effects of other signals or circuit structures are not involved, specific details of the working modes of the three stages may be understood by referring to the embodiment as shown in FIGS. 2*a* and 2*b*, and will not be described herein.

Figure 4A:
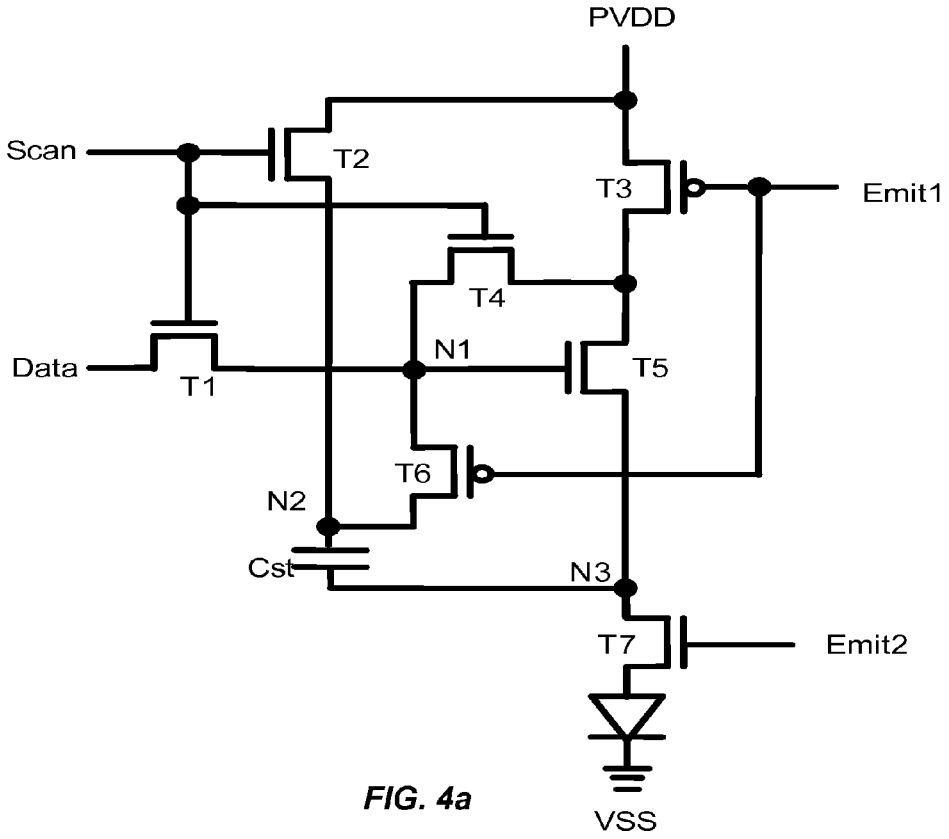
FIG. 4*a* is an OLED pixel compensation circuit according to an embodiment of the present disclosure.
Figure 4B:
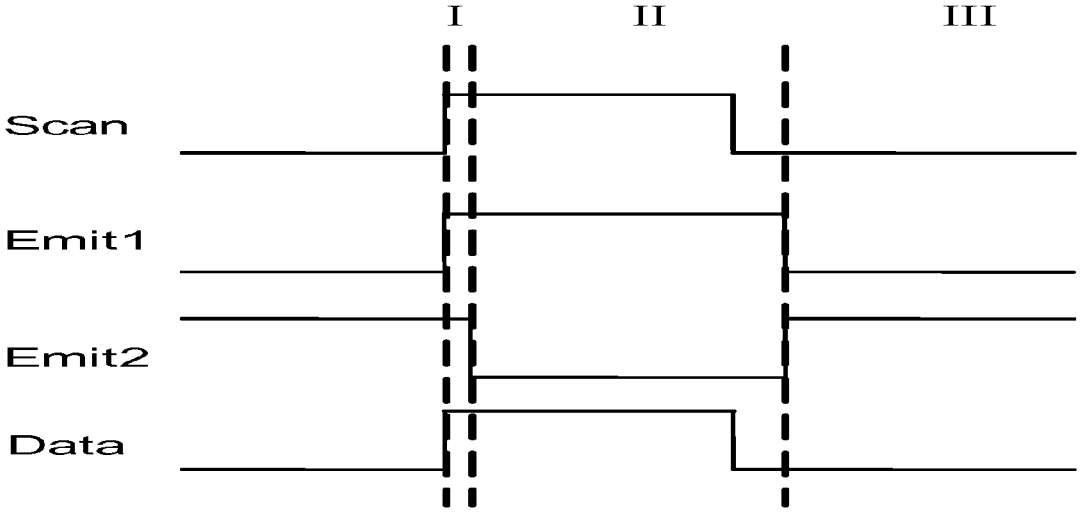
FIG. 4*b* is a timing diagram of an operation of the circuit shown in FIG. 4*a;*

Referring to FIGS. 4*a* and 4*b*, an embodiment is obtained based on the embodiment described above, as shown in FIG. 2*a* and FIG. 2*b*. A difference between the present embodiment and the above-described embodiment is that: in the present embodiment, a third transistor T3, a sixth transistor T6 are P-type Metal Oxide Semiconductor (PMOS) transistors, and first electrodes of these transistors are source electrodes and second electrodes of these transistors are drain electrodes. Correspondingly, levels in the three stages in driving the OLED pixel, accordingly to vary as follows.

In the first stage I (reset stage), the scan signal Scan is a high-level signal, the first light emitting signal Emit1 is a high-level signal, the second light emitting signal Emit2 is a high-level signal and the data signal Data is a high-level signal.

In the second stage II (threshold compensation stage), the scan signal Scan comprises a high-level signal, the first light emitting signal Emit1 is a high-level signal, the second light emitting signal Emit2 is a low-level signal and the data signal Data comprises a high-level signal.

In the third stage III (light emitting stage), the scan signal Scan is a low-level signal, the first light emitting signal Emit1 is a low-level signal and the second light emitting signal Emit2 is a high-level signal. It should be noted that, the data signal Data in this stage may be a high-level signal or a low-level signal.

A specific implementation process and a working principle in the present embodiment are similar to that in the embodiment as shown in FIGS. 2*a* and 2*b*, only because transistor types of the third transistor T3 and the sixth transistor T6 are changed from NMOS transistors into PMOS transistors, hence a level of a corresponding drive signal (the first light emitting signal Emit1) is also reversed. Since changes or influences of other signals or circuit structures are not involved, specific details of the working modes of the three stages may be understood by referring to the embodiment as shown in FIGS. 2*a* and 2*b*, and will not be described herein for the sake of brevity.

Figure 5A:
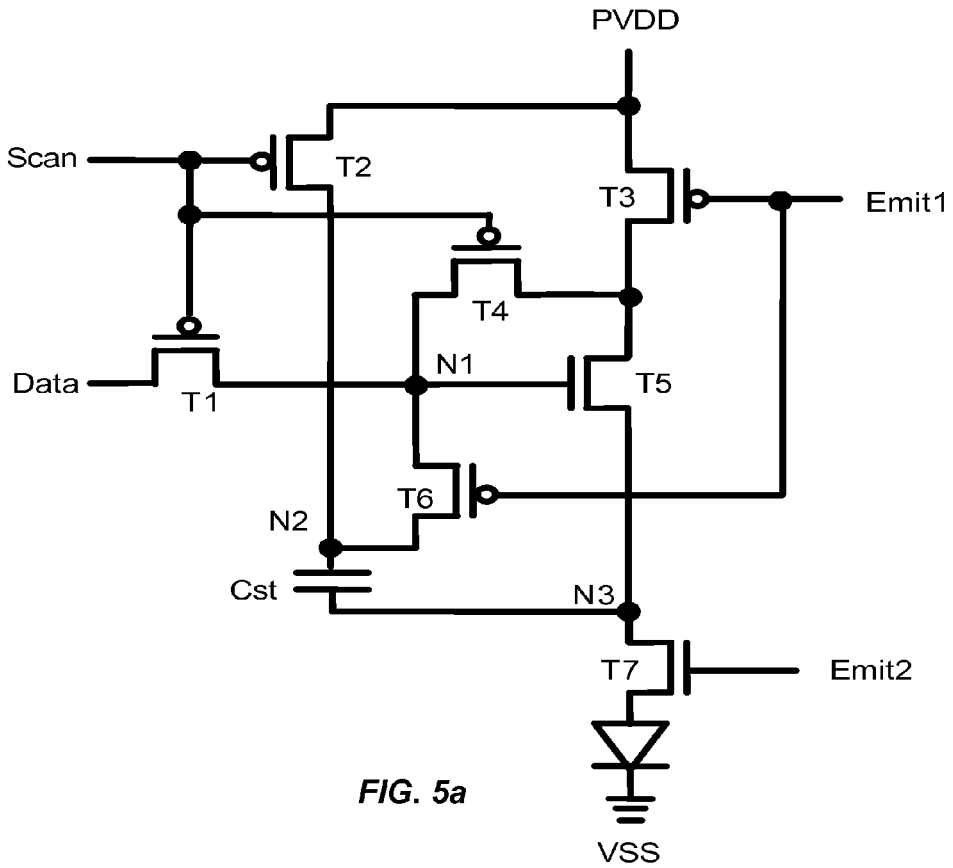
FIG. 5*a* is an OLED pixel compensation circuit according to an embodiment of the present disclosure.
Figure 5B:
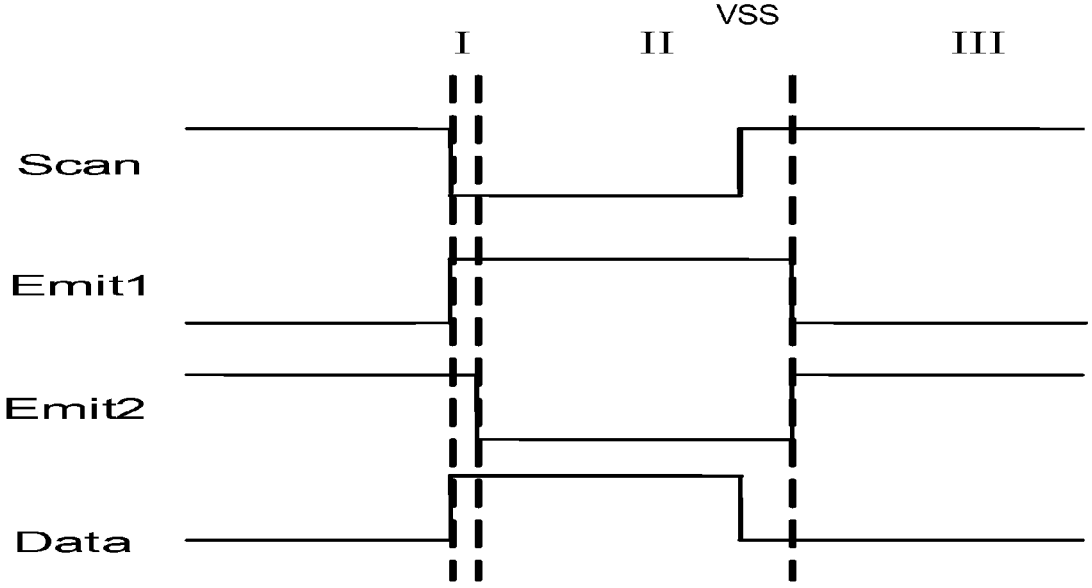
FIG. 5*b* is a timing diagram of an operation of the circuit shown in FIG. 5*a*.

Referring to FIGS. 5*a* and 5*b*, an embodiment is obtained based on the embodiment described above, as shown in FIG. 2*a* and FIG. 2*b*. A difference between the present embodiment and the above-described embodiment is that: in the present embodiment, a first transistor T1, a second transistor T2, a third transistor T3, a fourth transistor T4 and a sixth transistor T6 are PMOS transistors, and only a fifth transistor T5 and a seventh transistor T7 are NMOS transistors, and first electrodes of these PMOS transistors are source electrodes and second electrodes of these PMOS transistors are drain electrodes. Correspondingly, levels in the three stages in the driving the OLED pixel, accordingly to vary as follows.

In the first stage (reset stage), the scan signal Scan is a low-level signal, a first light emitting signal Emit1 is a high-level signal, the second light emitting signal Emit2 is a high-level signal and the data signal Data is a high-level signal.

In the second stage (threshold compensation stage), the scan signal Scan comprises a low-level signal, the first light emitting signal Emit1 is a high-level signal, the second light emitting signal Emit2 is a low-level signal and the data signal Data comprises a high-level signal.

In the third stage (light emitting stage), the scan signal is a high-level signal, the first light emitting signal Emit1 is a low-level signal and the second light emitting signal Emit2 is a high-level signal. It should be noted that, the data signal Data in this stage may be a high-level signal or a low-level signal.

A specific implementation process and a working principle in the present embodiment are similar to that in the embodiment as shown in FIGS. 2*a* and 2*b*, only because all transistor types of the first transistor T1, the second transistor T2, the third transistor T3, the fourth transistor T4 and the sixth transistor T6 are changed from NMOS transistors into PMOS transistors, hence a level of a corresponding drive signal (the scan signal Scan and the first light emitting signal Emit1) is also reversed. Since changes or influences of other signals or circuit structures are not involved, specific details of the working modes of the three stages may be understood by referring to the embodiment as shown in FIGS. 2*a* and 2*b*, and will not be described herein.

The OLED pixel compensation circuit according to any one of the embodiments as shown in FIGS. 3*a* and 3*b* to the embodiment as shown in FIGS. 5*a* and 5*b* may counteract an influence of the threshold voltage of the driving transistor (the fifth transistor T5) on the generated drive current and compensates the threshold voltage of the driving transistor. Thereby the drive current generated by the driving transistor does not deviate, and an OLED panel tends to display normally.

Furthermore, in all the above embodiments, the seventh transistor T7 is described by taking a NMOS transistor as example. However, in the case that the level of the second light emitting signal Emit2 is reversed, the seventh transistor T7 may be also replaced with a PMOS transistor.

The present disclosure further provides a display panel including the OLED pixel compensation circuit according to any one of the above embodiments.

The present disclosure further provides a display device including the OLED pixel compensation circuit according to any one of the above embodiments, or including the above display panel.

The display panel or display device is capable of counteracting the influence of the threshold voltage of the driving transistor (the fifth transistor T5) on the generated drive current and compensates the threshold voltage of the driving transistor, since it comprises the OLED pixel compensation circuit according to the above embodiments. So that the drive current generated by the driving transistor does not deviate and the OLED panel tends to display normally.

It should be noted that, the above embodiments may make reference to each other, and may be used in combination. Though the present disclosure is disclosed by way of preferred embodiments as described above, those embodiments are not intended to limit the present disclosure. By using the methods and the technical aspects disclosed above, possible variations and changes may be made to the technical scheme of the present disclosure by those skilled in the art without departing from the essential scope of the present disclosure. Therefore, any simple change, equivalent alternation and modification made to the above embodiments according to the technical principle of the present disclosure, which do not depart from the matters of the technical scheme of the present disclosure, all fall within the scope of protection of the technical scheme of the present disclosure.

What is claimed is:

1. An Organic Light Emitting Diode (OLED) pixel compensation circuit, configured to drive an OLED to emit light, the OLED pixel compensation circuit comprising: a first transistor, a second transistor, a third transistor, a fourth transistor, a fifth transistor, a sixth transistor, a seventh transistor, and a storage capacitor;

a gate electrode of the first transistor is directly electrically connected to a scan signal, a first electrode of the first transistor is directly electrically connected to a data signal, and a second electrode of the first transistor is directly electrically connected to a gate electrode of the fifth transistor;

a gate electrode of the second transistor is directly electrically connected to the scan signal, a first electrode of the second transistor is directly electrically connected to a power supply voltage, and a second electrode of the second transistor is directly electrically connected to a second electrode of the storage capacitor;

a gate electrode of the third transistor is directly electrically connected to a first light emitting signal, a first electrode of the third transistor is directly electrically connected to the power supply voltage, and a second electrode of the third transistor is directly electrically connected to a first electrode of the fifth transistor;

a gate electrode of the fourth transistor is directly electrically connected to the scan signal, a first electrode of the fourth transistor is directly electrically connected to the gate electrode of the fifth transistor, and a second electrode of the fourth transistor is directly electrically connected to the first electrode of the fifth transistor;

a second electrode of the fifth transistor is directly electrically connected to a first electrode of the seventh transistor;

a gate electrode of the sixth transistor is directly electrically connected to the first light emitting signal, a first electrode of the sixth transistor is directly electrically connected to the gate electrode of the fifth transistor, and a second electrode of the sixth transistor is directly electrically connected to the second electrode of the storage capacitor;

a gate electrode of the seventh transistor is directly electrically connected to a second light emitting signal, and a second electrode of the seventh transistor is directly electrically connected to a first electrode of the OLED;

a first electrode of the storage capacitor is directly electrically connected to the first electrode of the seventh transistor; and a second electrode of the OLED is directly electrically connected to a low-level signal, and the OLED emits light in response to a driving current generated by the fifth transistor.

2. The circuit according to claim 1, wherein the first transistor is configured to transfer the data signal to the gate electrode of the fifth transistor under the control of the scan signal;

the second transistor is configured to transfer the power supply voltage to the second electrode of the storage capacitor under the control of the scan signal;

the third transistor is configured to transfer the power supply voltage received by the first electrode of the third transistor to the second electrode of the third transistor under the control of the first light emitting signal;

the fourth transistor is configured to transfer the data signal received by the first electrode of the fourth transistor to the first electrode of the fifth transistor under the control of the scan signal;

the fifth transistor is configured to generate the drive current for driving the OLED to emit light;

the sixth transistor is configured to switch on the first and second electrodes of the sixth transistor under the control of the first light emitting signal;

the seventh transistor is configured to use the drive current generated by the fifth transistor to drive the OLED to emit light; and the storage capacitor is configured to store a received voltage, and couple a voltage change on the second electrode of the storage capacitor to the first electrode of the storage capacitor or couple a voltage change on the first electrode of the storage capacitor to the second electrode of the storage capacitor.

3. The circuit according to claim 1, wherein the fifth transistor and the seventh transistor are N-type Metal Oxide Semiconductor (NMOS) transistors.

4. The circuit according to claim 3, wherein the first transistor, the second transistor and the fourth transistor are NMOS transistors.

5. The circuit according to claim 4, wherein the third transistor and the sixth transistor are NMOS transistors or P-type Metal Oxide Semiconductor (PMOS) transistors.

6. The circuit according to claim 3, wherein the first transistor, the second transistor and the fourth transistor are PMOS transistors.

7. The circuit according to claim 6, wherein the third transistor and the sixth transistor are NMOS transistors or PMOS transistors.

8. The circuit according to claim 5, wherein, in the case that the third transistor and the sixth transistor are NMOS transistors, the circuit is configured to perform a first stage, a second stage and a third stage, wherein:

in the first stage, the scan signal is a high-level signal, the first light emitting signal is a low-level signal, the second light emitting signal is a high-level signal and the data signal is a high-level signal;

in the second stage, the scan signal comprises a high-level signal, the first light emitting signal is a low-level signal, the second light emitting signal is a low-level signal and the data signal comprises a high-level signal; and in the third stage, the scan signal is a low-level signal, the first light emitting signal is a high-level signal and the second light emitting signal is a high-level signal.

9. The circuit according to claim 5, wherein, in the case that the third transistor and the sixth transistor each are PMOS transistors, the circuit is configured to perform a first stage, a second stage and a third stage, wherein:

in the first stage, the scan signal is a high-level signal, the first light emitting signal is a high-level signal, the second light emitting signal is a high-level signal and the data signal is a high-level signal;

in the second stage, the scan signal comprises a high-level signal, the first light emitting signal is a high-level signal, the second light emitting signal is a low-level signal and the data signal comprises a high-level signal; and in the third stage, the scan signal is a low-level signal, the first light emitting signal is a low-level signal and the second light emitting signal is a high-level signal.

10. The circuit according to claim 7, wherein, in the case that the third transistor and the sixth transistor each are NMOS transistors, the circuit is configured to perform a first stage, a second stage and a third stage, wherein:

in the first stage, the scan signal is a low-level signal, the first light emitting signal is a low-level signal, the second light emitting signal is a high-level signal and the data signal is a high-level signal;

in the second stage, the scan signal comprises a low-level signal, the first light emitting signal is a low-level signal, the second light emitting signal is a low-level signal and the data signal comprises a high-level signal; and in the third stage, the scan signal is a high-level signal, the first light emitting signal is a high-level signal and the second light emitting signal is a high-level signal.

11. The circuit according to claim 7, wherein, in the case that the third transistor and the sixth transistor are PMOS transistors, the circuit is configured to perform a first stage, a second stage and a third stage, wherein:

in the first stage, the scan signal is a low-level signal, the first light emitting signal is a high-level signal, the second light emitting signal is a high-level signal and the data signal is a high-level signal;

in the second stage, the scan signal comprises a low-level signal, the first light emitting signal is a high-level signal, the second light emitting signal is a low-level signal and the data signal comprises a high-level signal; and in the third stage, the scan signal is a high-level signal, the first light emitting signal is a low-level signal and the second light emitting signal is a high-level signal.

12. The circuit according to claim 8, wherein the first stage is a reset stage for initializing the circuit.

13. The circuit according to claim 9, wherein the first stage is a reset stage, for initializing the circuit.

14. The circuit according to claim 8, wherein the second stage is a threshold compensation stage of the fifth transistor for capturing a threshold voltage of the fifth transistor.

15. The circuit according to claim 9, wherein the second stage is a threshold compensation stage of the fifth transistor for capturing a threshold voltage of the fifth transistor.

16. The circuit according to claim 8, wherein the third stage is a light emitting stage for driving the OLED to emit light.

17. The circuit according to claim 9, wherein the third stage is a light emitting stage for driving the OLED to emit light.

18. A display panel comprising the OLED pixel compensation circuit according to claim 1.

19. A display panel comprising the OLED pixel compensation circuit according to claim 2.

20. A display device comprising the OLED pixel compensation circuit according to claim 1.

* * * * *